United States Patent [19]

Wellman et al.

[11] Patent Number: 4,684,271

[45] Date of Patent: Aug. 4, 1987

[54] THERMAL TRANSFER RIBBON INCLUDING AN AMORPHOUS POLYMER

[75] Inventors: Russel E. Wellman, Southbury; Phyllis A. Cuming, Naugatuck, both of Conn.

[73] Assignee: Pitney Bowes Inc., Stamford, Conn.

[21] Appl. No.: 818,934

[22] Filed: Jan. 15, 1986

[51] Int. Cl.[4] ..... B41J 31/00

[52] U.S. Cl. ..... 400/241.1; 400/120; 428/913

[58] Field of Search ..... 400/121, 120, 241, 241.1, 400/241.2; 428/913; 346/76 PH, 76 R; 524/762, 831; 106/31, 32

[56] References Cited

U.S. PATENT DOCUMENTS

| | | | |
|---|---|---|---|
| 2,713,822 | 7/1955 | Newman | 346/76 R X |
| 3,744,611 | 7/1973 | Montanari et al. | 400/120 |
| 4,172,064 | 10/1979 | Keeler | 524/762 |
| 4,251,276 | 2/1981 | Ferree, Jr. et al. | 400/241 X |
| 4,269,892 | 5/1981 | Shattuck et al. | 400/120 X |
| 4,280,939 | 7/1981 | Johnson | 106/31 X |
| 4,291,994 | 9/1981 | Smith et al. | 400/241.1 |
| 4,308,318 | 12/1981 | Weiche | 400/120 X |
| 4,309,117 | 1/1982 | Chang et al. | 400/120 X |
| 4,320,170 | 3/1982 | Findlay | 400/120 X |
| 4,326,812 | 4/1982 | Pasini et al. | 400/121 |
| 4,327,365 | 4/1982 | Noda | 346/76 PH |
| 4,329,071 | 5/1982 | Applegate et al. | 400/120 |
| 4,465,389 | 8/1984 | Knirsch et al. | 400/241.1 |
| 4,571,363 | 2/1986 | Culbertson et al. | 428/913 X |

FOREIGN PATENT DOCUMENTS

| | | | |
|---|---|---|---|
| 0158344 | 10/1985 | European Pat. Off. | 400/241.1 |
| 0164688 | 12/1985 | European Pat. Off. | 400/241.2 |
| 0105382 | 6/1982 | Japan | 400/241 |
| 0165291 | 8/1985 | Japan | 400/241.1 |
| 1000682 | 8/1965 | United Kingdom | 400/241.1 |

OTHER PUBLICATIONS

IBM Technical Disclosure Bulletin, "Resistive Ribbon Thermal Transfer Printing Method", Crooks et al, vol. 19, No. 11, Apr. 1977, p. 4396.

IBM Technical Disclosure Bulletin, "Amorphous Film Printing Using DC Power and Pulse Selection", Aviram et al, vol. 25, No. 5, Oct. 1982, pp. 2602–2603.

IBM Technical Disclosure Bulletin, "Plasticized Resist Film", Bailey et al, vol. 25, No. 11B, Apr. 1983, pp. 6225–6226.

IBM Technical Disclosure Bulletin, "Matrix Transfer Medium Formulations", Beach et al, vol. 26, No. 2, Jul. 1983, pp. 716–717.

*Primary Examiner*—Ernest T. Wright, Jr.

*Attorney, Agent, or Firm*—Peter Vrahotes; David E. Pitchenik; Melvin J. Scolnick

[57] ABSTRACT

A ribbon for thermal transfer printing is disclosed. The ribbon comprises a substrate and an inking layer, the inking layer comprising low molecular weight polymer, a colorant, and an amorphous polymer.

12 Claims, No Drawings

THERMAL TRANSFER RIBBON INCLUDING AN AMORPHOUS POLYMER

This invention relates to thermal transfer systems and, more particularly, to transfer ribbons of improved durability.

BACKGROUND OF THE INVENTION

It is known in prior art to use ribbons in thermal transfer imaging processes. In these processes, thermal means are used to selectively heat areas of ribbon having an image transfer layer or coating. The printing is generally achieved by heat transferring the coating from the ribbon to paper by this local heating of the ribbon. Such image-localized heating may be accomplished by contacting the ribbon with point electrodes and a broad area contact electrode. The high current densities in the area of the electrodes during the applied voltage produces intense local heating which causes transfer of the coating from the ribbon to paper or receiving medium adjacent to or in contact with the ribbon. Various publications such as "IBM Technical Disclosure Bulletin, Resistive Ribbon Thermal Transfer Printing Method", Crooks, et al., vol. 19, No. 11, Apr. 1977, p. 4396 illustrate this general thermal transfer technique. Printers and some other hardware used in these methods are disclosed in U.S. Pat. Nos. 4,326,812; 4,327,365 and 4,329,071.

Various ribbons have been suggested for use in these thermal processes. These ribbons usually contain a resistive layer, a conductive layer and a hot melt ink layer. When the current is selectively applied to the ribbon in image configuration, the resistive material heats up causing the ink at that point to transfer to the printing surface. It has been found that after flexing and continued use of this ribbon, cracking and loss of the ink layer frequently occurs. This cracking is caused primarily because of relatively poor adhesion of the ink layer to the Mylar or other substrate used.

There have been suggested several varieties and combinations of ink layers and substrates in an attempt to improve adhesion and durability. U.S. Pat. Nos. 2,713,822 and 3,744,611 both describe non-impact printing processes employing a ribbon ink layer and ribbon substrate. The ink layer generally comprises a mixture of carbon black or dye and waxes. Many of the early ink layers had relatively poor rub resistance and layer adhesion. Several improved ribbons have been proposed which provide beneficial properties over the earlier used ribbons. Some of these improved ribbons are disclosed in U.S. Pat. Nos. 4,172,064; 4,269,892; 4,291,994; 4,308,318; 4,309,117 and 4,320,170. Several ink layers contain water-based coatings such as described in U.S. Pat. No. 4,172,064. Although water-based coatings have substantial advantages, the practical difficulties of forming good coatings from water-borne systems are not easily overcome. Since most organic polymer systems that would be expected to be candidates to form attractive coatings are not soluble in water, the organic phase must be present as a latex, i.e. as a colloidal macromolecular stabilized suspension. The polymer itself must demonstrate superior film characteristics after the solvent has evaporated. To do this the film formation process must proceed through an evaporative process depositing the organic polymer as well as forming a coherent film by the coalescence of the discrete polymer particles. Similarly, the polymer itself must be capable of film coalescence during the evaporation and, once formed, must be tough and resistant to both detergents and solvents. Finally, the polymer system chosen should be capable of being made industrially, since not every polymer precursor can be combined with others in proportions that will give the physical properties that are desired in the resulting polymer system.

In order to form a coherent film on a substrate from a latex, a coalescing agent is usually incorporated. These materials are usually ether-alcohol compounds with typical materials being methyl, ethyl or butyl CELLOSOLVE, butyl CARBINOL, butyl carbinol acetate and the like. The function of the coalescing agent is to soften and reduce the viscosity of the non-aqueous phase so that the individual particles fuse together to form the required continuous film as the aqueous phase disappears during drying. The coalescing agent may be slowly volatile and will thus leave the film after it has formed. Since the interaction between the coalescing agent and the polymer phase must occur during the drying process and at the polymer-water and polymer-polymer interfaces, the optimum coalescent agent tends to be a specific component for a given system. The specific coalescent agent is chosen to be one which functions best with the specific copolymer system being used to form the coherent film.

Because the aqueous coating compositions are used to coat substrates that may or may not be easily wet by water, a surfactant system should be incorporated. The surfactant must be compatible with any surfactant system that may already be present at the polymer surface, being present both as emulsifier and stabilizer from the polymerization process. Similarly, the surfactants must not interfere with the coalescing agent in its fusion role. The surfactant lowers the surface tension of the aqueous system so that the coating formulation wets both the printing plate or device, as well as the substrate onto which the coating is being applied. Under these conditions the printing or coating can be applied by conventional equipment already in use in the trade. Since these printing devices are often rotating cylinders which dip into the aqueous material while rotating at high speed, the surfactants chosen must be effective but must not produce excessive foam either at the supply fountain or at the surface as the printing or coating transfer of material occurs.

In a practical coating system, there are also employed several auxiliary ingredients so-called because they have only minor effects on the physical properties intrinsic to the polymeric coating. These added materials are vital to a useful product. They include pigments to give the coating color and opacity, anti-foam agents to reduce foaming, anti-freeze components to give the system freeze-thaw resistance, and fungicides and mildewcides to minimize degradation. There may also be present ultraviolet light stabilizers and anti-oxidants and, while all of these components would be most important and necessary for a useful product and must be chosen so that they would not interact either with the basic polymer system or with each other, they have minor effect on the intrinsic properties of the coating system itself.

In U.S. Pat. No. 4,269,892 a ribbon having a transfer coating and a novel substrate containing a polyester resin containing from about 15% to 40% by weight of electrically conductive carbon black is disclosed. In U.S. Pat. No. 4,291,994 a tear resistant ribbon for thermal transfer processes is disclosed. The substrate is made from a polycarbonate, a block copolymer of bisphenol A carbonate and dimethyl siloxane. A novel substrate made from polyurethane is disclosed in U.S. Pat. No. 4,320,170. These three patents 4,269,892; 4,291,994 and 4,320,170 disclose new substrates for use in thermal transfer processes while patents 4,172,064; 4,308,318 and 4,309,117 disclose novel ink layers use in thermal transfer processes. The balance attempted to be achieved in each of these above-discussed patents is compatibility of substrate and ink layer to achieve maximum long-range use. While all of these proposed ribbons present a variety of improvements, they generally do not have sufficient or at least good enough adhesion to the Mylar or other substrates to permit crinkling of the thermal transfer ribbon without some cracking and loss of effectiveness of the ink layer.

SUMMARY OF THE INVENTION

It is therefore an object of this invention to provide an improved thermal transfer ribbon devoid of the above-noted disadvantages.

Another object of this invention is to provide a thermal transfer ribbon having improved ink layer-substrate adhesion.

Yet another object of this invention is to provide a durable thermal transfer ribbon with improved layer adhesion without causing the ink to offset.

A further object of this invention is to provide a novel ink layer that comprises a sharp melting polymer and an amorphous polymer that permits good quality images with substantially complete transfer of the ink.

Still another object of this invention is to provide a novel non-tacky outer surface thermal transfer ribbon that also affords good, sharp images.

Yet still another object of this invention is to provide a novel thermal transfer ribbon having improved properties.

Another still further object of this invention is to provide a novel ink layer that permits transfer by the use of low energy or low transfer energy.

The foregoing objects and others are accomplished by the present invention generally speaking by providing a novel thermal transfer ribbon wherein a small amount of an amorphous polymer with a glass transition temperature below room temperature is included in the inking layer (transfer layer). The improved results are achieved particularly with the inking layer disclosed in our copending application having Ser. No. 818,935, filed Jan. 25, 1986. In this copending application a sharp melting semi-crystalline polymer such as polyhexamethylene sebacate is used in the inking layer. This sebacate layer has many desirable properties and its adhesion to the Mylar substrates is significantly improved when an amorphous polymer with a glass transition temperature at or below normal room temperature (i.e., a glass transition temperature below 30° C.) is incorporated in the inking layer. The amorphous polymers used are rubbery or tacky at room temperature. Although inclusion of a tacky material in the ink would be expected to lead to undesirable tackiness and pressure transfer or offsetting, as well as blocking of the inked ribbon, this does not occur in the present invention. This is accomplished by using polymeric materials which result in the tacky or rubbery polymer being in contact with the Mylar substrate and protected on the outer surface by a suitable coating of the sharp melting polymer. Thus, the ribbon of the present invention has an ink layer with an inner tacky surface in contact with the substrate and an outer non-tacky surface generally of the sharp melting polymer. As described in the literature, or performed by the products introduced to date, ink is coated onto an intermediary material such as film, paper, or ribbon. The thermal head, in contact with the ink carrier which is in turn in contact with the surface to be printed generates sufficient heat to cause the ink on the back of the "ink donor material" to transfer to and penetrate the receptor surface. One variation described in the literature but not yet implemented as a product is preheating the ink and selectively transferring it from a cylinder.

The ink and substrate are the keys to thermal transfer.

Various known prior art substrates have been used including Mylar, condenser paper, other polyesters and conductive polyurethanes. Of these, two substrates are most commonly used; that is Mylar and special condenser paper. In the present invention, Mylar substrates are preferred. The Mylar ranges in thickness from 3.5 to 6 microns and the special condenser paper ranges in thickness from about 10 to 13 microns. Condenser paper is used in thermal line printers in widths ranging from about 33 to 267 mm. Polyester film, such as Mylar, is found in thermal serial printers in common widths of 6.35, 8.0 and 12.7 mm. The length of both condenser paper and polyester film depends upon the space available in the printer or ribbon cassettes. The ink transfer layer of the present invention, in addition to the amorphous polymer, preferably contains at least one low molecular weight polymer and a partially crystalline polymer which does not become soft until the crystalline portion starts to melt with the polymeric crystalline portion having a melting point substantially below 90° C. The semi-crystalline polymer used in this invention preferably melts in the range of about 45° C. to about 75° C. Examples of these ink component materials are polycaprolactone and polyesters such as polyhexamethylene adipate, polymerized long side chain acrylates and acrylamides such as polydocosyl acrylate and their copolymers. Obviously, suitable mixtures of these materials may be used if desirable. Typical polyesters that are useful in the thermal transfer ribbon of this invention are derived from dicarboxylic acids such as sebacic acid or adipic acid and straight chain glycols such as 1,6 hexanediol. The long side chain acrylates and acrylamides have as the esterifying moeity (or attached to the nitrogen atom in the acrylamide) a non-branched aliphatic group containing from 12 to 30 carbon atoms.

The preferred low molecular weight polymers permit attainment of the low transfer energy while avoiding the deficiencies caused by low temperature softening by using a crystalline or partially crystalline polymer which does not become soft until the crystalline portion starts to melt. If the semi-crystalline polymer is sufficiently tough and flexible to provide a good, adherent, and non-flaking coating when coated at the desired thickness, it can be applied directly, for example, as a hot melt coating. However, most prior art materials that have the other desired characteristics (including low viscosity at a temperature close to the crystalline melting point) are not suitable for coating by themselves. Some prior art polyamides could be used in this way but their crystalline melting points are commonly about 90° C. which is higher than desired. It has been shown that other polymers which do not have the required transfer properties can be used to provide the flexible, adherent coating without a major effect on the transfer of the sharp-melting polymer. If the transfer ribbon does not have to withstand significant abrasion, a sharp-melting monomeric material could be used in place of the polymer. However, in general, monomeric materials will abrade too easily even when held in a polymeric matrix since they cannot be well encapsulated and still transfer easily and completely. In the present invention we have used preferably, together with the amorphous polymer, a low molecular weight polyhexamethylene sebacate as the semi-crystalline polymer. However, there are many other semi-crystalline polymers which melt in the range of 45° C. to 75° C. and could be used for this application. For example, polyesters such as polyhexamethylene adipate, polymerized long side chain acrylates and acrylamides (such as polydocosyl acrylate which melts at about 60° C.) and their copolymers and polycaprolactone.

The term "low molecular weight" polymer as used herein means a molecular weight below 2000.

The term "low energy" as used herein means, as an example, only 3 joules per square cm. when the Ricoh thermal head is used; for example, the 400 dot Ricoh thermal head. When other thermal heads are used the equivalent low energies required may be easily determined.

"Semi-crystalline" or "partially-crystalline" when used in this disclosure shall mean a composition containing a significant amount of an amorphous material but with a melting point essentially determined by the crystalline portion of said com- position.

The term "amorphous polymer" when used in this disclosure shall mean a polymer containing materials without stratification or crystalline structure.

The term Mylar or insulating substrate herein means a Mylar (with or without an aluminum coating).

Any suitable amorphous polymer that has a glass transition temperature below room temperature may be used in the present invention. Suitable amorphous polymers are Reichhold 97-329 (which is a trademark of Reichhold Chemical Company of White Plains, N.Y. for a non-ionic, aqueous emulsion of a self-crosslinking acrylate latex), Chemcor 831 B, Chemcor XL20, Chemcor 20A30, Chemcor being a trademark of Chemcor Chemical Corp. of North Salem, N.Y., the three Chemcor composition being non-ionic, aqueous emulsions of polyethylene, Sybron N-90, Sybron N-80, Sybron being a trademark of Sybron Corporation of Rochester, N.Y. for a non-ionic, aqueous emulsion of polyethelene, Versaflex-5, Versaflex being a trademark of W. R. Grace Co. of New York, N.Y. for a non-ionic, aqueous emulsion of acrylic latex Coatrez-4004 and Coatrez-4048, Coatrez being a trademark of Interez Corp., each material being a non-ionic, aqueous emulsion of acetate polyvinyl acrylic copolymer. Any of these materials or mixtures thereof may be used if suitable to provide the desired tackiness to the ink layer.

EXAMPLES AND PREFERRED EMBODIMENTS

The following examples describe the present invention with reference to the preferred embodiments.

EXAMPLE 1

Sebacic Acid and 1,6 Hexanediol (10:9 mol ratio) were reacted together to form a low molecular weight polyhexamethylene sebacate (HMS #2). After reacting until the temperature reached 181° C.; and cooling; 500 g of the product was purified by extraction with 1500 ml boiling heptane. The heptane was decanted off and product air dried. 190 gm of this HMS #2 reacted 1 hr @ 80°-100° C. with 3.8 Basonyl Red 540. 7 gm of this dyed HMS #2 was heated (with stirring) to 75° C. with 30 ml Chemcor 2-67A, a non-ionic, aqueous high density polyethylene emulsion, and 1 ml Triton X305 surfactant, Triton being a trademark of Rohm and Haas for a non-ionic, aqueous solution of alkylaryle polyether alcohol to form a stable latex, then cooled with stirring. 12 ml Reichhold 97-329 latex (amorphous, tacky polymer) and 48 ml Chemcor 135-50 a non-ionic, aqueuos paraffin emulsion were blended in. This latex was coated onto 25 S Mylar with a #24 wire-wound rod. After drying, the sheet was slit into 3.3 cm strips. These "thermal transfer ribbons" were non-tacky, had excellent ink adhesion to the Mylar, gave no pressure offset, and gave good, sharp images on a Pitney Bowes 8400 facsimile machine.

EXAMPLE 2

Sebacic Acid and Adipic Acid (5:1 mol ratio) were reacted together with 1,6 Hexanediol (10:9 acid-diol mol ratio) to form a less crystalline analog of HMS (HMSA). After reacting until the temperature reached 185° C., the material was cooled, then purified by extraction with boiling heptane, and air dried. 7 gm of this HMSA was reacted in a beaker with 0.17 gm of red dye at 100° C. for 15 min. The dyed HMSA was blended with 30 ml 2-67A emulsion and 20 ml of a 1% Basonyl Yellow 120 dye-1% Triton X100, a non-ionic, aqueous solution of alkylaryl polyether alcohol surfactant solution and heated to 75° C. with stirring to form a stable latex. After cooling with stirring, 40 ml CHEMCOR 135-50 paraffin emulsion and 6 ml Reichhold 97-329 latex were added. This latex was coated on 25 S Mylar with a #24 wire-wound rod. The coating, when dry, was slit into 3.3 cm wide strips. These "thermal transfer ribbons" were non-tacky, did not pressure offset, had excellent ink adhesion to the Mylar, and gave extremely good, sharp images when tested.

EXAMPLE 3

Sebacid Acid and 1,6 Hexanediol (10:9 mol ratio) were reacted together until the temperature reached 182° C. After cooling, the material was purified by extraction with boiling heptane and air dried. 20 g of this HMS was dyed with 0.2 gm Neptune Red 543 dye and 0.5 gm Baso Yellow 124 dye in a beaker at 100° C. for 15 min. This dyed HMS was heated with 80 gm 2-67A polyemulsion and 25 ml of a 1% Triton X100 surfactant solution to approx. 75° C. to form a stable latex, then cooled with mechanical stirring. 40 ml Chemcor EM150 emulsion, 10 ml Reichhold 97-329 latex and 4 gm Basoflex Pink 4810 pigment dispersion were blended into the latex, 3 ml of a 50% Ammonium hydroxide solution was added to reduce viscosity slightly. This latex was coated onto 25 S Mylar with a #24 rod. After drying, the sheet was slit into 3.3 cm wide strips. These "thermal transfer ribbons" were non-tacky, did not pressure offset, had good ink adhesion to the Mylar, and gave good, sharp images when tested.

The preferred and optimumly preferred embodiments of the present invention have been described herein and shown in the examples to illustrate the underlying principles of the invention, but it is to be understood that numerous modifications and ramifications may be made without departing from the spirit and scope of this invention.

What is claimed is:

1. A ribbon for thermal transfer printing comprising: a substrate and an inking layer, said inking layer comprising a low molecular weight polymer, a colorant, and an amorphous polymer, said substrate and said inking layer having a tacky interface and said inking layer having a substantially non-tacky outer surface.

2. The ribbon of claim 1 wherein said amorphous polymer is tacky at room temperature.

3. The ribbon of claim 1 wherein said amorphous polymer has a glass transition temperature below room temperature.

4. The ribbon of claim 1 wherein said substrate is a substrate comprising Mylar.

5. A ribbon for thermal transfer printing comprising an electrically resistive substrate layer and an ink transfer layer positioned on said substrate layer, said ink transfer layer comprising an amorphous polymer having a glass transition temperature below room temperature, said ink transfer layer having a tacky interface surface and a non-tacky outer surface.

6. The ribbon of claim 5 wherein said amorphous polymer has a glass transition temperature below about 30° C.

7. The ribbon of claim 5 wherein said tacky interface is between said ink transfer layer and said substrate.

8. The ribbon of claim 5 wherein said ink transfer layer comprises at least one low molecular weight polymer, a colorant and said amorphous polymer, at least one of said low molecular weight polymers comprises a partially crystalline polymer having a molecular weight up to about 2000 which melts in the range of about 45° C. to 75° C.

9. The ribbon of claim 5 wherein said substrate is made from a material comprising Mylar.

10. A ribbon for non-impact thermal transfer printing which comprises an electrically resistive substrate and an ink transfer layer positioned above said substrate, said ink transfer layer having at the interface with said substrate a tacky surface; said ink transfer layer comprising at least one low molecular weight polymer, a colorant and an amorphous polymer having a glass transition temperature below room temperature; said ink transfer layer comprising a partially crystalline polymer from a member selected from the group consisting of polycaprolactone, polyhexamethylene adipate, polyhexamethylene sebacate, polymerized long side chain acrylates polymerized, long side chain acrylamides, their copolymers and mixtures thereof.

11. The ribbon of claim 12 wherein said substrate is made from a material comprising of Mylar.

12. The ribbon of claim 10 wherein said amorphous polymer has a glass transition temperature below about 30° C.

* * * * *

UNITED STATES PATENT AND TRADEMARK OFFICE

CERTIFICATE OF CORRECTION

PATENT NO. : 4,684,271

DATED : August 4, 1987

INVENTOR(S) : Russel E. Wellman and Phyllis A. Cuming

It is certified that error appears in the above-identified patent and that said Letters Patent are hereby corrected as shown below:

Column 3, line 49; "January 25" should be --January 15--.

Column 8, line 23; "Claim 12" should be --Claim 10--.

Signed and Sealed this

Twenty-seventh Day of December, 1988

*Attest:*

DONALD J. QUIGG

*Attesting Officer*

*Commissioner of Patents and Trademarks*